US005953763A

United States Patent [19]

Gouget

[11] Patent Number: 5,953,763

[45] Date of Patent: Sep. 21, 1999

[54] SAFETY URINAL

[76] Inventor: Jacques Maurice Gouget, 3, Rue D'Auteuil, Paris 75016, France

[21] Appl. No.: 09/126,724

[22] Filed: Jul. 31, 1998

Related U.S. Application Data

[63] Continuation-in-part of application No. 08/737,879, Nov. 11, 1996, abandoned.

[51] Int. Cl.[6] ..... A47K 11/00

[52] U.S. Cl. ..... 4/144.1; 4/449

[58] Field of Search ..... 4/144.1, 144.2, 4/144.3, 144.4, 450, 454, 449

[56] References Cited

U.S. PATENT DOCUMENTS

| | | | |
|---|---|---|---|
| 3,568,218 | 3/1971 | Beckman | 4/144.1 |
| 4,164,795 | 8/1979 | Johnson | 4/144.1 |
| 5,701,612 | 12/1997 | Daneshvar | 4/144.1 |
| 5,839,123 | 11/1998 | Dunham, Sr. | 4/144.1 |

*Primary Examiner*—David J. Walczak
*Attorney, Agent, or Firm*—Michael D. Bednarek; Crowell & Moring LLP

[57] ABSTRACT

A urinal of transparent or translucent plastic material that can endure a sterilization temperature of 130° C., with a detachable anti-backflow element having an interior end located at the volumetric center of the urinal. The urinal also includes a normal fill level indicator, such as a groove in the side of the urinal, and a conduit and cap located above the normal fill level of the urinal. The anti-backflow device, normal fill level, and conduit and cap combine to prevent spillage form the urinal at any angle of tilt so long as the contents of the urinal remain at or below the normal filling level. In addition, emptying of the contents is facilitated by virtue of the conduit and cap location above the normal fill level. The urinal also includes other features, such as an internal odor tablet holding device, unique coloring and phosphorescent features for selected elements of the urinal, a specially designed cradle for holding or hanging the urinal, and either a fixed or attachable handle.

20 Claims, 3 Drawing Sheets

SAFETY URINAL

This application is a Continuation-in-Part (CIP) of applicant's currently application titled IMPROVED SAFETY URINAL having U.S. Ser. No. 08/737,879 filed Nov. 11, 1996, now abandoned.

FIELD OF THE INVENTION

The present invention relates to the field of safety urinals. In particular, the present invention describes features for a transparent or translucent plastic material urinal with a maximum fill indicator that is able to withstand sterilization temperature above 130° C., has an anti-backflow system that includes a screw-type release, in which the interior end of the system is located at the volumetric center of the urinal, such that the urinal may be tilted in any direction without spillage so long as the urinal is not filled beyond the fill indicator level, and an improved feature for quick emptying that prevents release of odors.

BACKGROUND OF THE INVENTION

Existing art for safety urinals includes devices made of transparent or translucent plastic material that are able to endure a sterilization temperature of 130° C. In addition, existing art for urinals includes anti-backflow systems that are removable by unscrewing to permit cleaning of the unit; this feature is indispensable for emptying the urinal.

A drawback of existing urinals is that, during the emptying of the contents of a urinal via the large orifice of the neck typical of these urinals, the confined internal air of the urinals typically escaped unpleasantly toward the handler. Further, whether they involve a detachable or a fixed handle, existing urinal manufacturing techniques that involve blowing are such as to pose problems of tightness of fit in the case of manufactures done by mass production.

Examples of existing art for urinals, also referred to as urine collection containers are as follows. Hanifl, et al., URINE COLLECTION CONTAINER, U.S. Pat. No. 5,358,148 describes a simple hollow container with a sealable opening and a non-venting spout permitting pouring of contents from the container.

Haq, PORTABLE URINAL, U.S. Pat. No. 5,331,689 describes a portable urinal with a body, a flexible urine receiving tube external to the urinal, and an opening for releasing air from the urinal during filling. Also described is a urine specimen container connectable within the receiving tube.

Neither of these devices contain an anti-backflow device within the body of the urinal to prevent spillage. In addition, neither has a provision for detecting when it is near the full level, and neither describes internal odor prevention feature, features to distinguish the container in darkened environments or to distinguish particular features of the container, or a holder or hanger for easy use.

Deburgh, PORTABLE MALE URINAL, U.S. Pat. No. 4,091,476 describes a urinal which includes an elongated container with a frontal orifice for receiving the male organ, an internal tube slanting inwardly to prevent spillage, an outflow pipe, and an undersheet for securing the container in place while in use. The internal tube is not designed optimally for both filling and spillage prevention for the urinal. Further, this device describes no internal odor prevention feature, features to distinguish the container in darkened environments or to distinguish particular features of the container, or a holder or hanger for easy use.

Nakao, et al., URINATING RECEIVER, U.S. Pat. No. 4,050,103, describes a urine storage tank, a urinating receiver, a urinating discharge pipe between the receiver and the tank, and a hanging device for suspending the device. The device contains no anti-backflow feature within the body of the urinal to prevent spillage, has no provision for detecting when it is near the full level, describes no internal odor prevention feature, and contains no features to distinguish the container in darkened environments or to distinguish particular features of the container from one another.

Chenault, MALE URINAL, U.S. Pat. No. 2,358,850 describes a urinal having a trap, a handle fixed rigidly to the urinal, a screw cap, and a plug. The urinal of Chenault, however, does not describe a removable handle, does not have an internal odor prevention feature, color and phosphorescent features for particular elements of the system, and is not particularly designed in such a manner to maximize filling capacity while preventing spillage via an anti-backflow system.

It is thus clear that there is a need for a urinal that is composed of clear materials with a fill indicator, combined with an anti-backflow device with an interior end at the volumetric center point of the urinal, such that the anti-backflow device, when the urinal is filled to the indicated level, prevents spillage from the urinal.

SUMMARY OF THE INVENTION

It is an object of the present invention to solve the problems of the existing art by providing a safety urinal of transparent or translucent plastic material with a fill indicator that can endure a sterilization temperature of 130° C. having a removable anti-backflow element having its interior end located at the volumetric center and a "quick emptying" feature that dispenses with the necessity of removing the anti-backflow element for emptying. It is a further object of the present invention to prevent spillage from the urinal at any angle of tilt when the contents of the urinal are below the fill indicator level. It is a further object of the present invention to provide a urinal with an internal odor tablet holding device. It is a further object of the present invention to provide unique or distinguishing coloring and/or phosphorescence to selected elements of the urinal. It is a further object of the present invention to provide a specially designed cradle for holding or carrying the urinal. It is a further object of the present invention to provide a fixed handle for the urinal. It is a further object of the present invention to provide an attachable handle for the urinal.

To achieve the stated and other objects of the present invention, as embodied and described below, the invention includes a urinal, comprising a urinal body comprising a translucent or transparent plastic material capable of enduring a sterilization temperature of 130° C. with an interior having a volumetric center point and a normal filling level, a planar base, an elongated neck portion with an axis of elongation having an opening for receiving an anti-backflow element, and a conduit opening located above the normal filling level of the urinal; a stopper with an outside contour and an inner contour; a conduit having attachment means for attaching the stopper to the conduit opening such that a water-tight seal forms, wherein the conduit allows directed flow from the urinal body; an anti-backflow element insertable within the urinal neck, the anti-backflow element having a body comprising a funnel shape with a larger end opening and a smaller end opening; and neck attaching means for attaching the larger end opening of the anti-backflow element to the neck of the urinal body such that a water-tight seal forms and such that the smaller end opening is oriented so as to overhang into the urinal body interior and the smaller end opening is situated at the volumetric center point of the urinal body.

Additional objects, advantages and novel features of the invention will be set forth in part in the description which follows, and in part will become more apparent to those skilled in the art upon examination of the following or may be learned by practice of the invention.

DETAILED DESCRIPTION

Figure 1:
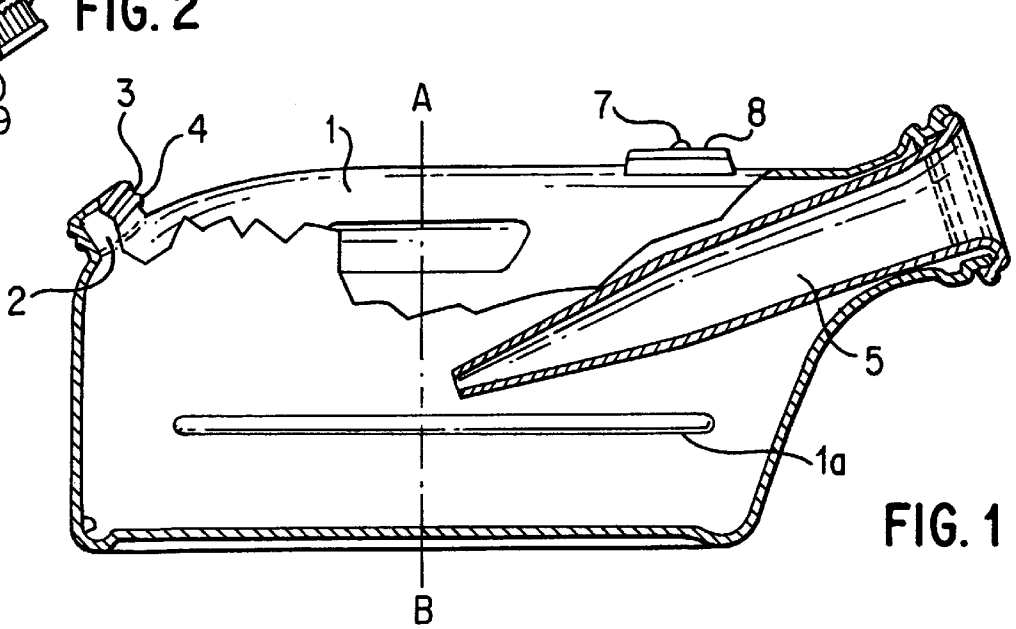
FIG. 1 is a cutaway side view of the urinal for an embodiment of the present invention.

An embodiment of the present invention includes a safety urinal of transparent or translucent plastic material that can endure a sterilization temperature of 130° C. having a fill indicator to indicate a maximum fill level. In an embodiment of the present invention, the fill indicator includes a groove on at least one side of the urinal. In an embodiment of the present invention, the maximum fill level indicated is just below the volumetric center of the urinal, such that the urinal at the maximum fill level holds contents that do not reach the volumetric center of the urinal whatever the urinal's orientation in space.

In an embodiment of the present invention, the urinal has a removable anti-backflow element attached to the urinal by, for example, a threaded fitting. In this embodiment, the anti-backflow element has an interior end situated at the volumetric center of the urinal.

An embodiment of the present invention also contains an improved feature for quick emptying, which dispenses with the necessity of removing the anti-backflow device during emptying. The quick emptying feature also prevents release of odors when emptying.

In an embodiment of the present invention, the wall of the urinal contains a hole situated toward the end of the urinal opposite its neck. This hole, which is positioned above the normal level of filling, is surmounted by a conduit which forms a pouring spout that directs the exiting stream from the urinal. The diameter of the hole and that of the conduit which surmounts it are sufficient to ensure rapid emptying of the urinal. This spout also enables directed precision pouring of the contents of the urinal; for example, the spout allows the filling of a test tube. In an embodiment of the present invention, the conduit has at its end a means for receiving a closing feature or stopper, such as a threaded cap, to quickly stop or unstop the hole. The combination of the hole, the conduit, and the cap constitute the quick emptying system of the improved safety urinal.

The quick emptying system avoids the necessity of removing and/or manipulating the anti-backflow element located at the neck of the urinal each time that it is necessary to empty the contents of the urinal. A rinsing of the urinal via the quick emptying feature may also be conducted.

In an embodiment of the present invention, the quick emptying feature includes an internal section that is judiciously limited so as to allow the emptying contents of the urinal to easily occupy the whole section. As a result, as opposed to existing art, no passage exists through which the internal air of the urinal can escape during emptying. Thus, the handler is not inconvenienced.

Other advantages of the quick emptying feature of this embodiment include the following. When the safety urinal is immersed in a cleaning basin, the opening of the quick emptying feature, when not stopped, facilitates the rinsing of the entire inside of the improved urinal. A flexible tube with a threaded connection is connectable to the conduit of the quick emptying feature via its external threading. The other end of the flexible tube can be inserted in an emptying siphon of the type used to receive emptyings from washing machines or other receptacles. This device thus permits a practical and hygienic emptying of the improved safety urinal. A similar connection with the flexible tube branched to a water inlet can also be used for internal rinsing of the improved safety urinal, especially in a hospital environment.

In an embodiment of the present invention, a stopper system such as a cap stops the conduit of the quick emptying feature of the urinal. This stopper system is either composed of a simple plug introduced into the conduit, or by a jointed or self-jointing cap with a lip that may be screwed on the end part of the conduit. The cap has for this attachment purpose an internal threading matable with an external threading on the conduit.

To prevent an untimely emptying by, for example, a bedridden patient not having all of his or her mental faculties, the stopper system includes a feature known as a safety screw or "child-proof cap" (jointed or self-jointing), which once screwed, requires exertion at the same time of a strong pressure, generally axially, in order to unscrew it. Failing this, the unscrewing does not engage. This safety screw cap if not so unscrewed, emits a click-clack noise warning of the attempt at unstopping. In another embodiment, the cap does not emit any noise during the attempt unstop.

In another embodiment of the present invention, the means for avoiding undesired unstopping is a cap and conduit with a left hand thread pitch, instead of the normal right hand thread pitch.

To permit more easy removal of the simple plug, in an embodiment of the present invention, the upper part of the plug contains a circular shoulder permitting easy grabbing. The simple plug is made of a flexible material which can sustain a temperature of 130° C. In an embodiment of the present invention, the plug is made of flexible silicone. This material, during successive unstoppings and re-stoppings, offers the advantage of tolerating well the aggressiveness of the orifice of the quick emptying feature and of withstanding a temperature of 130° C.

In another embodiment of the present invention, the stopper is a cap, which, in order to facilitate unscrewing and rescrewing, is equipped on the periphery with grooves. In an embodiment of the present invention, the screw cap is of plastic material capable of withstanding 130° C. In an embodiment of the present invention, the material of construction of the cap is a substance of the family of polyolefins.

In an embodiment of the present invention, the color of the plug for the quick emptying feature of the improved safety urinal is selected so as to draw attention to the cap. In an embodiment of the present invention, the cap is of a different color than the body of the improved urinal. For example, the cap may be red or white in color to permit finding it easily and for perceiving quickly that it is well put into place in the orifice of the quick emptying system. A fluorescent color is likewise appropriate.

In an embodiment of the present invention, the stopper contains or is made of a material that stores photons when the stopper is in a lighted environment and emits photons in the form of light when the stopper is in darkness (e.g., a phosphorescent material). This feature eases locating of the urinal and stopper in unlighted conditions.

In an embodiment of the present invention, the stopper for the quick emptying feature of the urinal includes a cavity oriented toward the inside of the conduit when the stopper is in place. This cavity and its orifice are designed so that the stopper may hold, by, for example, elastic means, a small perforated container. This container in turn holds a volatile tablet of the same kind as those placed in toilet bowls. The tablet purifies the air contained in the urinal when the "quick emptying" system is stopped.

In an embodiment of the present invention, the hole and its conduit also allow sampling of the contents of the urinal and introduction of probes for indicating the pH, etc., of the contents. The hole and conduit are also suitable for introducing and attaching a probe ending in the proximity of the small opening end of the anti-backflow element. This probe has, at its end, means such that when the end of the probe is wetted for a certain time, the end establishes an electric contact triggering a sound alert that the urinal needs emptying.

The color of the material constituting the anti-backflow element of the improved safety urinal in an embodiment of the present invention is different from that of the urinal body. This color scheme distinguishes the anti-backflow element as a separate feature from the urinal body, as a portion of the element extends beyond the end of the neck of the urinal. The coloring further indicates where to grasp the anti-backflow element in order to remove it from the urinal. The coloring also eases filling of the urinal by allowing estimation of the height of the contents remaining by comparison with the small opening of the anti-backflow element.

Once in place, the anti-backflow element inserted within the urinal body determines the maximum use capacity of the urinal; the maximum volume that the urinal with the anti-backflow element and the quick plug in place can receive is that amount of fill necessary such that the contents do not reach the interior end of the anti-backflow element, regardless of the orientation of the urinal in space. When the urinal is filled to its maximum use capacity, its liquid content cannot reach and spill via the small end of the anti-backflow element, no matter what angle in which the urinal is tilted. Thus, in an embodiment of the present invention, the small end of the anti-backflow element is defined as being located at the volumetric center of the urinal body.

In an embodiment of the present invention, two prehension notches are located on the sides of the urinal. These prehension notches allow handling of the urinal by its top side (under the handle) such that it is more easily grasped. The prehension notches thus reduce the risk of dropping the urinal on the floor.

In order to safely prevent untimely unscrewing of the anti-backflow element, by for example, bedridden patients not having all their mental faculties, in an embodiment of the present invention, this feature is attached by threading with a left-handed pitch, rather than the more typical right-handed thread.

For ease of handling and better hygiene, in an embodiment of the present invention, the improved urinal is equipped with a removable or fixed handle. In an embodiment of the present invention, the handle is of a plastic material that can withstand a sterilization temperature of 130° C. In an embodiment of the present invention, the handle is located on the top side of the urinal such that, when the said urinal is filled to its maximum use capacity, its handling feels stable. Further, in an embodiment of the present invention, the handle includes at its end at least one small boss, so that the handle won't slip from the hands during handling.

To make the packaging less voluminous and to make transporting the improved safety urinal more economical, in an embodiment of the present invention the removable handle is of dimensions such that the handle can clear the neck of said urinal so that the handle may be housed in the urinal during transport and storage.

In an embodiment of the present invention, the urinal includes a removable handle with the following features. The back of the improved safety urinal contains at least one tab having an axis of symmetry parallel to the axis of the urinal. This tab has on each side of its base a longitudinal slide or coupling. A mating slide or an analogous system equipped so as to receive the tab exists in a cavity in the base of the handle. The two side edges of the slide each contain a retainer capable of fitting the tab introduced by sliding in the slide. A stop limits the sliding. A stub or its equivalent situated on the top of the tab is elastically positioned in a hollow housing provided for this purpose in the slide or near it, or vice versa. The handle thus may be sturdily attached, while remaining detachable. In another embodiment, the handle is undetachable once attached: in this embodiment, the handle stub and its counterpart each have a vertical side making the snapping on irreversible.

In an embodiment of the present invention, the urinal includes a fixed handle with the following features. In the case of the manufacture of the urinal from a hollow mass, the mass is dimensioned and positioned so that it extends in the mold beyond the imprint of the urinal in the zone corresponding to the back of the urinal. The knives of the mold are judiciously arranged so that beyond the contour of the imprint of the improved safety urinal they can cut in the profile of the handle the flat mass that is in excess, while leaving the base of the handle connected to the body of the improved safety urinal. During the closure of the mold, the knives cut the mass following the contour of the imprint, except in the area of the foot of the handle, for which they cut the outside contour while hot stamping the handle. The handle is housed in the two half cavities, which are not at all deep enough to contain it; a hot pressure results, melding the two walls between the cavities.

To make the flat handle of an embodiment of the present invention easier to grasp, in an embodiment of the present invention, the half cavities in the mold forming the housing of the handle have for this purpose at certain points symmetric differences of depth so as to press the plastic material coming out of the mass to make it flow back to other points in the more hollow half cavities in a symmetric manner. This feature thickens the handle at certain points, the cavities having made in this way a veritable hot mold, causing the plastic to flow back from less hollow points to more hollow points. By this hot molding procedure one may also deform the handle on the part provided for grasping it by creating undulations to increase its bulk.

In an embodiment of the present invention, an antiseptic, whether perfumed or not, is grafted for hygiene purposes into the material constituting the body of the urinal, the material of its handle, the material of the anti-backflow element, and the material of its filler. In an embodiment of the present invention, plugs, caps, handles, and the anti-backflow element materials are of a density such that, in case of falling into water or other contents of the urinal, these items float and are thus easily retrievable.

To make the use of the urinal even more practical, an embodiment of the present invention includes a urinal cradle or holder that can be hung on the side of the bed by a hook that forms part of the cradle. When the urinal is hung by a cradle as described in this embodiment, the urinal remains within handy reach of the bedridden patient.

In an embodiment of the present invention, the urinal carrier is essentially constituted of three branches or rods composed of a material or materials sterilizable at 130° C. The branches are suitably curved so as to form an open cage, and the branches are joined at two points by, for example, welding. In another embodiment, the carrier is made of a single piece of plastic material formed by molding. An advantage of the carrier is its great simplicity, which makes mass production trouble free and facilitates its maintenance and its disinfection.

The urinal carrier thus constitutes a type of open cradle in which the urinal rests. For this purpose the cradle's shape and dimensions are specially established to receive the urinal and to keep it laterally in a vertical position (neck in the air). In an embodiment of the present invention, the urinal cradle is sufficiently open in the front so as to leave the grasping notches and/or the handle of the urinal easily accessible. Another feature, which prevents the ends of the branches of the carrier from being harmful, is the fitting of tips of flexible material at the end of the branches.

Advantages of the present invention for the patient include the following. If the urinal rolls over in bed, there is no problem—sheets remain dry. The urinal will not leak. It is strong, light and easy to handle, even in the dark. Emptying of the urinal is at the back with the quick emptying system. To seal the quick emptying system, the user twists on either the standard white cap, which is easy to remove, or a childproof red cap, which prevents any unintended opening. The urinal also includes extra slope in the neck, which makes for easier use. No cover is needed, and the urinal is always ready to be used. Finally, the urinal has a capacity of approximately 1 liter (32 oz), so the patient can fall asleep peacefully.

Advantages of the present invention for the institution include the following. With regard to security, even if the urinal is rolled over in bed, its contents cannot spill thanks to its simple but effective design. The urinal therefore prevents the discomfort of wet beds and avoids the need to frequently change and wash the patient's sheets. The urinal helps to fight nosocomial infections and reduces the need for frequent disinfecting, and the urinal is re-usable. At night, the urinal may be left in the bed, and thus is instantly available to the patient, who need not call for assistance. The urinal is nearly odor free and does not need a cover. It is made of smooth, clear recyclable plastic, and its transparency allows checking of its contents. The urinal has a graduated measure up to 1 liter (32 oz), and the handle, which is removable, allows for a firm grip. The urinal is light, shock resistant and the quick emptying system together with the removable funnel makes the urinal easy to clean and re-use. The urinal can be washed (with water+chlorine or disinfectant), and sterilized by autoclave or ethylene oxide. Finally, the quick emptying system allows a quick, practically odorless, and even more hygienic emptying.

The urinal of the present invention is also economical. In hospitals, care centers, retirement homes, or simply at home, using the urinal reduces the need for cleaning and disinfecting and provides an incomparable comfort to the patient.

References will now be made in detail to an embodiment of the present invention, an example of which is illustrated in the accompanying drawings.

FIG. 1 presents an elevation view of an embodiment of the present invention showing a partial cutaway along the line CD (shown in FIG. 4) of the urinal body. Features illustrated include the anti-backflow element, which can be unscrewed at the neck, the quick emptying feature with its threaded neck offering a relatively limited internal section for emptying, and the protuberance forming tab to fit exactly in a detachable way in the slide or an analogous system situated in the base of an attachable handle. In FIG. 1, the urinal 1 shown illustrates some of the invention's unique features. A hole 2 situated above the normal filling level of the urinal 1 is surmounted by a conduit 3 with its threading 4 established so as to allow screw attachment of a self-jointing, lipped cap 8 for plugging the hole 2. The anti-backflow element 5 is attached by a screwable (threaded) fitting so as to be water-tight and so that the element 5 is held within the neck of the urinal 1. The anti-backflow element 5 permits orienting of the urinal 1 at any angle when normally filled without its contents escaping by virtue of the fact that the end 5*a* of the anti-backflow element 5, located within the interior of the urinal 1, is situated at the volumetric center of the urinal. A tab 6 situated at the top of the urinal 1 permits the slide (not shown in FIG. 1; see slide 12 in FIG. 3) of the handle (not shown in FIG. 1; see FIG. 3) to be attached by snapping on in a detachable way. The handle is further held in place by a stub 7 after having been stopped by a stop on the handle (not shown in FIG. 1; see FIG. 3). The embodiment of the urinal 1 shown in FIG. 1 also includes a groove 1*a* in the side of the urinal 1, so as to indicate a maximum fill level. This maximum fill level is such that the contents of the urinal 1 will not rise to a level so as to exceed the level of the volumetric center of the urinal 1. The clear material of construction of the urinal 1, when combined with the groove 1*a*, allows the fill level to be kept at or below the maximum fill level.

The functioning of the anti-backflow element 5 can be discerned by further examination of FIG. 1 (see also FIG. 4, below). When a little liquid flow is introduced in the element 5, the liquid travels by gravity through the tubular funnel shape portion of the anti-backflow element 5 towards its smaller end. This liquid then flows into the body of the urinal 1 and an equivalent volume of air escapes from the urinal 1 via the smaller end of the anti-backflow element 5. The diameter of the smaller end of the anti-backflow element 5 is designed so it cannot be completely obstructed by liquid flow: the air escapes, and there is no liquid backflow inside the anti-backflow element 5 nor spillage from the urinal.

Figure 1A:
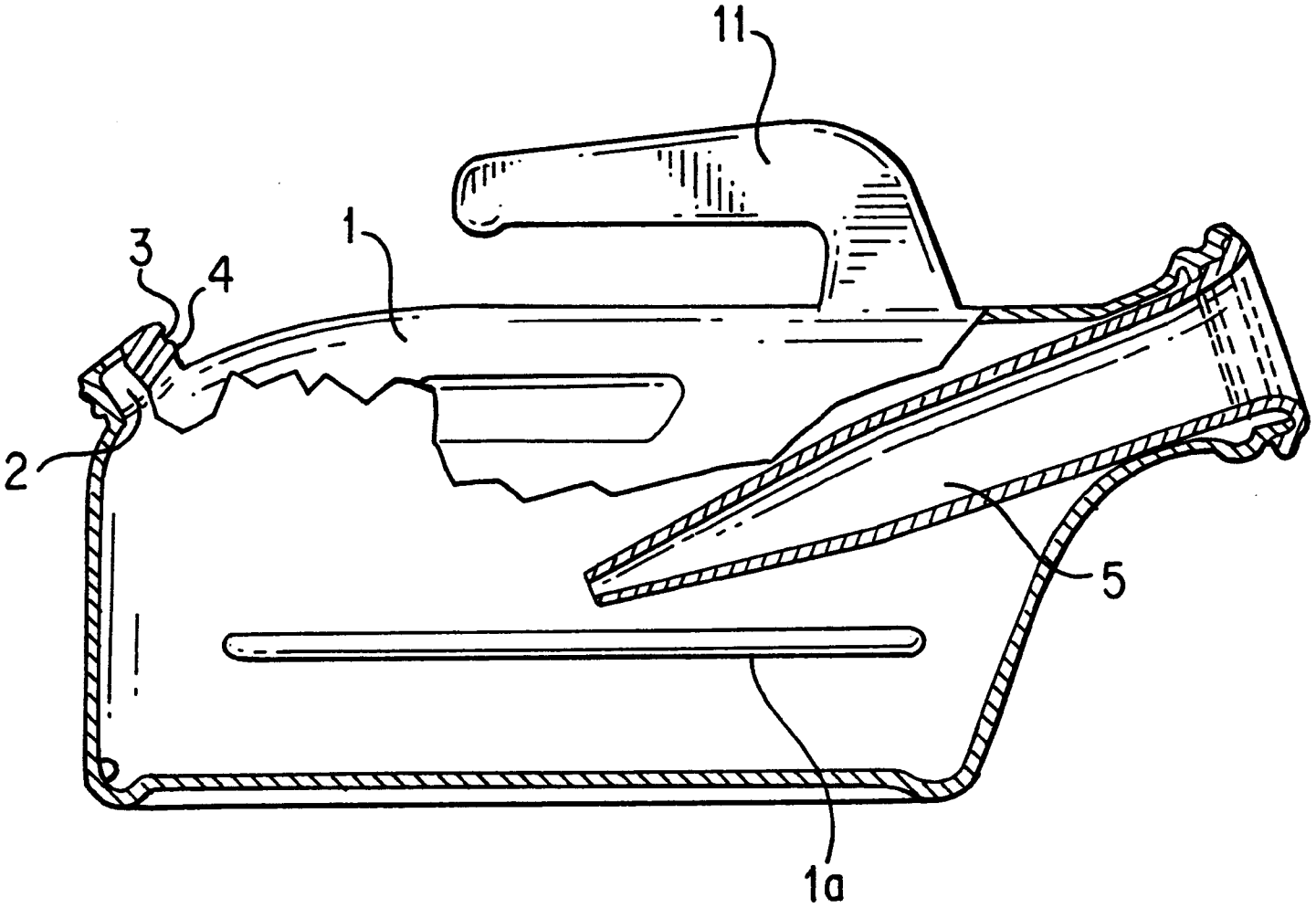
FIG. 1A is a cutaway side view of the urinal for an embodiment of the present invention with a fixed handle in place.

FIG. 1A presents an elevation view of an embodiment of the present invention similar to that view presented in FIG. 1 but with a permanently attached handle 11 shown.

Figure 2:
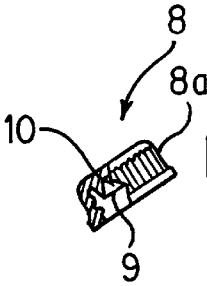
FIG. 2 is a partial cutaway view of a cap for the urinal for an embodiment of the present invention.

FIG. 2 presents an elevation view of an embodiment of the present invention showing a partial-cutaway of the self-jointing screw cap (with lip). Inside the lip, a disinfectant tablet is inserted elastically. As shown in FIG. 2, a self-jointing screw cap 8 is attachable by screwing (threading) onto the conduit 3. The cap 8 is designed so as to plug the conduit 3 in a water-tight manner in conjunction with a conical lip 9. A tablet 10 of, for example, disinfectant product is housed elastically in the lip 9 to help sanitize the inside of the urinal 1 when the cap 8 is installed.

Figure 3:
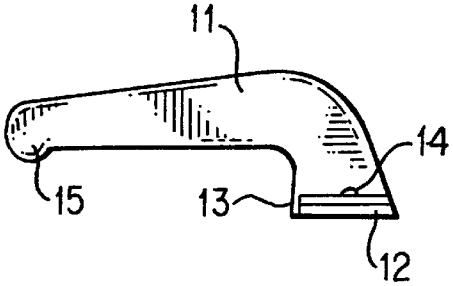
FIG. 3 is a partial cutaway side view of an attachable handle for the urinal for an embodiment of the present invention.

FIG. 3 presents an elevation view of an embodiment of the present invention showing a partial cutaway of the base of the removable handle showing the slide or an analogous system of slides and tongue for attachment of the handle to the urinal. As shown in FIG. 3, the detachable handle 11 with its slide 12 is equipped with a stop 13 against which the tap (not shown in FIG. 3; see tap 6 in FIG. 1) stops the handle 11 against the housing 14 of the handle 11 when by sliding the stub (not shown in FIG. 3; see stub 7 in FIG. 1) penetrates into the handle 14.

Figure 4:
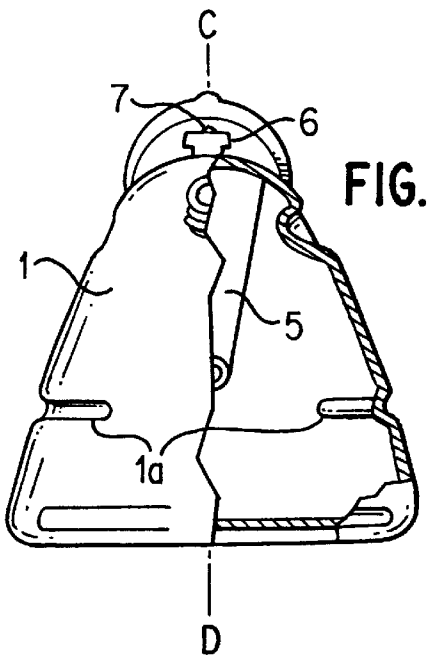
FIG. 4 is partial cutaway rear view of a urinal for an embodiment of the present invention.

FIG. 4 is a rear elevation of the embodiment of the present invention shown in FIG. 1 for a half-cutaway view along the line AB (shown in FIG. 1) and containing the sectional profile of the tab for sliding in the slide of the handle. FIG. 4 includes the urinal 1 with its anti-backflow element 5, from an end view, and the profile of the tab 6 and the stub 7.

Figure 5:
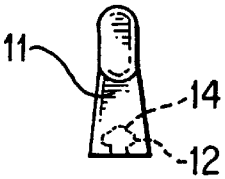
FIG. 5 is cutaway end view of an attachable handle for the urinal for an embodiment of the present invention.

FIG. 5 presents the detachable handle for an embodiment of the present invention from a rear elevation view showing with dotted lines the section of the handle's slide containing the housing for the stub. In FIG. 5, the handle 11 has an inner vacancy 12 for the slide of the urinal and a housing 14 for receiving the stub of the urinal.

Figure 6:
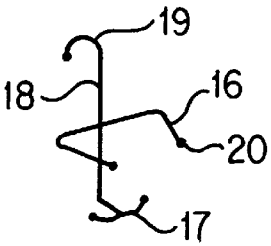
FIG. 6 is a urinal holder for an embodiment of the present invention.

FIG. 6 presents a perspective view, on a very reduced scale, of the carrier for the improved safety urinal for an embodiment of the present invention, in which the carrier consists of three curved rods assembled by welding and ends fitted with tips of flexible material. As shown in FIG. 6, in this embodiment the urinal carrier consists of three rods 16, 17, and 18 judiciously bent, and assembled via attachment at two points, to form an open cradle that offers easy access to the prehension notches of the urinal of the present invention, as well as to the handle. The spine branch 18 is curved to form a hook 19 for hanging the carrier. So that the ends of the rods do not cause injury, they are fitted with tips 20 of flexible material. In an embodiment of the present invention, the rods 16, 17, and 18 consist of painted or plastic covered iron or stainless steel.

Figure 7A:
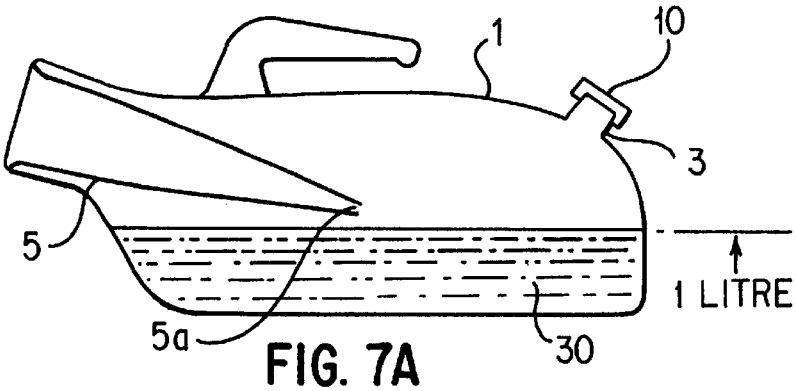
FIGS. 7A–7D illustrate a urinal in various orientations when filled to the maximum filled level for an embodiment of the present invention.

FIGS. 7A–7D illustrate the urinal 1 in various orientations when filled to the maximum filled level for an embodiment of the present invention. In FIG. 7A, the urinal 1 is shown in an upright position, the normal position for the urinal 1 in use. The urinal 1, as shown in FIG. 7A contains liquid contents 30 at or below the maximum fill level, such that the contents 30 remain below the volumetric center of the urinal, which corresponds to the location of the interior end 5*a* of the anti-backflow device 5. In FIG. 7A, the conduit 3 has a stopper 10 in place.

Figure 7B:
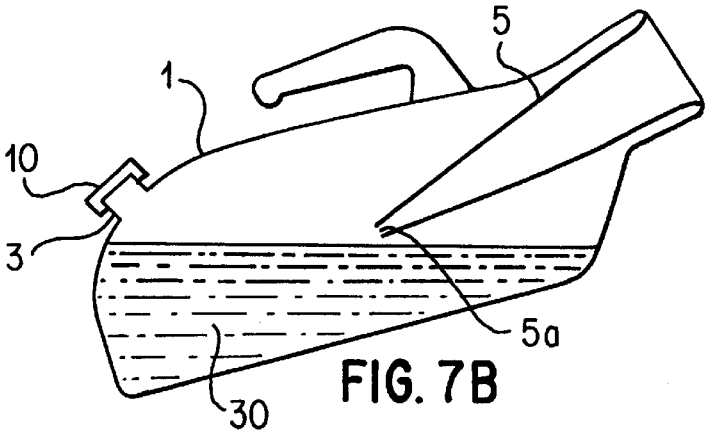

FIG. 7B presents the urinal 1 of FIG. 7A shown in a tilted position. As shown in FIG. 7B, despite the tilt of the urinal 1, the contents 30 remain below the volumetric center of the urinal 1, at which point the interior end 5*a* of the anti-backflow device 5 is located.

Figure 7C:
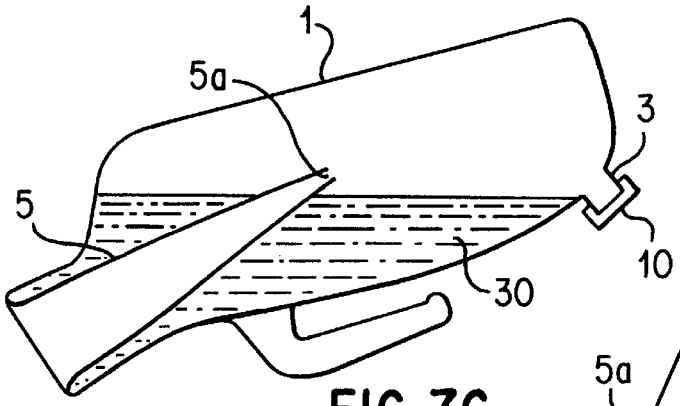

Similarly to FIG. 7B, FIG. 7C shows the urinal 1 of FIG. 7A in another tilted position. In FIG. 7C, the urinal 1 is inverted and tilted. The contents 30 remain below the volumetric center of the urinal 1, at which point the interior end 5*a* of the anti-backflow device 5 is located. Further, the cap 10 on the conduit 3, also prevents spillage of the contents 30.

Figure 7D:
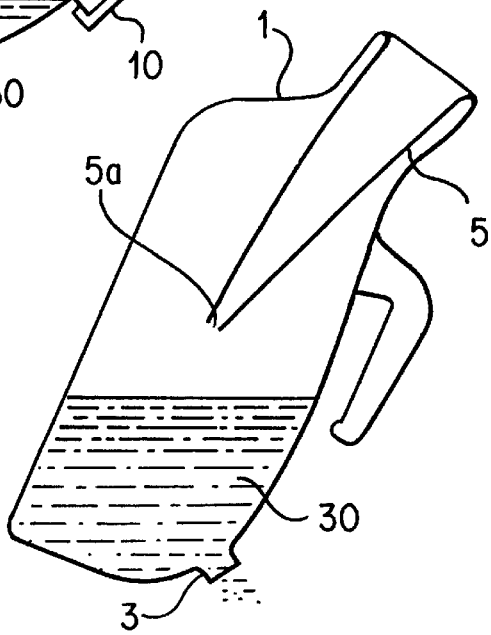

FIG. 7D presents the urinal 1 of FIG. 7A in a position for emptying. Because of the location of the conduit 3, while the urinal 1 is in the normal filling position, as shown in FIG. 7A, the cap 10 may be removed from the conduit 3 without spilling the contents 30 of the urinal 1. The urinal 1 may then be upended to the position shown in FIG. 7D, so that the contents of the urinal 1 may be directed from the urinal 1 via the conduit 3.

What is claimed is:

1. A urinal, comprising:

a urinal body comprising a translucent or transparent plastic material capable of enduring a sterilization temperature with an interior having a volumetric center point and a normal filling level, a planar base, an elongated neck portion with an axis of elongation having an opening for receiving an anti-backflow element, and a conduit opening located above the normal filling level of the urinal;

a stopper with an outside contour and an inner contour;

a conduit having attachment means for attaching the stopper to the conduit opening such that a water-tight seal forms, wherein the conduit allows directed flow from the urinal body;

an anti-backflow element insertable within the urinal neck, the anti-backflow element having a body comprising a funnel shape with a larger end opening and a smaller end opening; and neck attaching means for attaching the larger end opening of the anti-backflow element to the neck of the urinal body such that a water-tight seal forms and such that the smaller end opening is oriented so as to overhang into the urinal body interior and the smaller end opening is situated at the volumetric center point of the urinal body.

2. The urinal according to claim 1, further comprising:

a handle attachment means on the urinal body; and a handle attachable to the handle attachment means.

3. A urinal according to claim 2, wherein the handle attachment feature comprises a tab, a stub, a slide, a stop, and a housing.

4. A urinal according to claim 2, wherein the handle comprises at least one extended boss such that the boss provides a point upon which the fingers of a hand grasping the handle rest.

5. A urinal according to claim 2, wherein the handle has dimensions such that the handle is insertable into the opening in the neck of the urinal body.

6. The urinal according to claim 1, wherein the conduit attachment means comprises a left-handed thread.

7. The urinal according to claim 1, wherein the conduit attachment means further includes a self-jointing safety feature.

8. The urinal according to claim 1, wherein the exterior contour of the stopper comprises grooves.

9. The urinal according to claim 1, wherein the color of the exterior contour of the stopper is distinguishable from the color of the urinal body.

10. The urinal according to claim 1, wherein the stopper comprises a phosphorescent material.

11. The urinal according to claim 1, wherein the stopper further comprises a lip within the inner contour of the stopper such that a cavity for holding a tablet of perfumed product is formed.

12. The urinal according to claim 1, wherein the color of the anti-backflow element is distinguishable from the color of the urinal body.

13. The urinal according to claim 1, wherein the neck attachment means comprises a left-handed thread.

14. A urinal according to claim 1, wherein the axis of the neck is inclined relative to the plane of the base of the urinal at an angle between 10 and 30 degrees.

15. A urinal according to claim 1, wherein the material of construction of the urinal comprises plastic material grafted with substances of a nature so as to render the urinal antiseptic.

16. A urinal according to claim 1, wherein the material of construction of the urinal comprises plastic material grafted with substances of a nature so as to render the urinal perfumed.

17. The urinal according to claim 1, further comprising a handle attached to the urinal body.

18. The urinal of claim 1 further including a groove on the urinal body, the groove indicating the normal filling level for the urinal, wherein the groove is positioned so as to prevent spill from the urinal so long as the urinal is not filled beyond the normal filling level.

19. The urinal of claim 1 wherein the urinal body has at least two opposing sides, further including a pair of grooves, one groove on each of two opposing sides of the urinal body, each groove indicating the normal filling level for the urinal, wherein each groove is positioned so as to prevent spill from the urinal so long as the urinal is not filled beyond the normal filling level.

20. A urinal, comprising:

a urinal body comprising a translucent or transparent plastic material with an interior having a volumetric center point and a normal filling level, a planar base, an elongated neck with an axis of elongation having an opening, and a conduit opening located above the normal filling level of the urinal;

stopping means with an outside contour and an inner contour;

conduit means having attachment means for attaching the stopper to the conduit opening such that a water-tight seal forms, wherein the conduit means allows directed flow from the urinal body;

an anti-backflow element insertable within the urinal neck, the anti-backflow element including a body comprising a funnel shape with a larger end opening and a smaller end opening; and neck attaching means for attaching the larger end opening of the anti-backflow element to the neck of the urinal body such that a water-tight seal forms and such that the smaller end opening is oriented so as to overhang into the urinal body interior and the smaller end opening is situated at the volumetric center point of the urinal body.

* * * * *